US006512498B1

(12) United States Patent
Favalora et al.

(10) Patent No.: US 6,512,498 B1
(45) Date of Patent: Jan. 28, 2003

(54) VOLUMETRIC STROBOSCOPIC DISPLAY

(75) Inventors: Gregg E. Favalora, Cambridge, MA (US); Shawn T. Samuel, Cambridge, MA (US)

(73) Assignee: Actuality Systems, Inc., Reading, MA (US)

( * ) Notice: Subject to any disclaimer, the term of this patent is extended or adjusted under 35 U.S.C. 154(b) by 0 days.

(21) Appl. No.: 09/598,275

(22) Filed: Jun. 19, 2000

Related U.S. Application Data

(60) Provisional application No. 60/140,243, filed on Jun. 21, 1999.

(51) Int. Cl.[7] ..... G09G 3/00
(52) U.S. Cl. ..... 345/30
(58) Field of Search ..... 345/30, 31, 32, 345/6, 7, 8, 84, 87, 108, 110; 348/51, 52

(56) References Cited

U.S. PATENT DOCUMENTS

| | | | | |
|---|---|---|---|---|
| 3,140,415 A | | 7/1964 | Ketchpel | 313/146 |
| 4,319,805 A | | 3/1982 | Nicolas | 350/120 |
| 4,689,604 A | | 8/1987 | Sokol | |
| 4,983,031 A | | 1/1991 | Solomon | 353/10 |
| 5,042,909 A | | 8/1991 | Garcia, Jr. et al. | 359/478 |
| 5,479,153 A | | 12/1995 | Yi et al. | |
| 5,717,416 A | | 2/1998 | Chakrabarti | |
| 5,813,742 A | * | 9/1998 | Gold et al. | 353/88 |
| 5,854,613 A | | 12/1998 | Soltan et al. | 345/32 |
| 5,945,966 A | | 8/1999 | Acantilado | 345/6 |
| 6,052,100 A | * | 4/2000 | Soltan et al. | 345/6 |
| 6,177,913 B1 | * | 1/2001 | Whitesell | 345/6 |
| 6,208,318 B1 | * | 3/2001 | Anderson et al. | 345/1 |

* cited by examiner

*Primary Examiner*—Richard Hjerpe
*Assistant Examiner*—Ronald Laneau
(74) *Attorney, Agent, or Firm*—Fish & Richardson P.C.

(57) ABSTRACT

In a volumetric display, a strobe source illuminates a moving object at successive instants separated by potentially unequal time intervals. By specifying these intervals, an illumination controller achieves eye-catching visual effects suitable for advertising kiosks or other public displays. The volumetric display includes a signal generator configured to generate a first and second signals. An illumination controller interleaves these signals and provides the resulting interleaved signals to a strobe unit that is disposed to illuminate the moving object in response to the interleaved signals.

26 Claims, 5 Drawing Sheets

VOLUMETRIC STROBOSCOPIC DISPLAY

CROSS-REFERENCE TO RELATED APPLICATIONS

This application claims the benefit of the priority date of U.S. Provisional Application Ser. No. 60/140,243 filed on Jun. 21, 1999, the contents of which are herein incorporated by reference.

FIELD OF INVENTION

This invention relates to volumetric displays and in particular, to stroboscopically illuminated rotating advertising kiosks.

BACKGROUND

There are many examples of volumetric (volume-filling) autostereoscopic (viewable with the unaided eye) 3-D display systems. For example, U.S. Pat. No. 3,140,415 (Three-Dimensional Display Cathode Ray Tube) discloses a spinning phosphor-coated flat disc which is addressed by a cathode ray gun. The spinning motion allows the display to present luminous points in three dimensions, creating a volumetric autostereoscopic display.

Similar results may be achieved with lasers, as disclosed in U.S. Pat. No. 5,042,909 (Real Time Three Dimensional Display with Angled Rotating Screen and Method) and U.S. Pat. No. 5,854,613 (Laser Based 3D Volumetric Display System). One or more lasers may be used to illuminate regions of a rotating helical screen to produce volumetric imagery.

In U.S. Pat. No. 4,319,805 (Rotary Screen for Receiving Optical Images Particularly Advertising Images), a projector shines imagery onto a rotating screen encased within a spherical enclosure. This requires costly projection optics, a large housing, and suffers from low image quality due to the screen's motion with respect to the projector.

However, the above volumetric displays use costly components such as lasers, computationally intensive illumination control systems, and difficult-to-manufacture display surfaces. As a result, such systems are not suitable for high-volume, publicly accessible displays such as advertising.

SUMMARY OF THE INVENTION

A volumetric display for illuminating a moving object uses a small number of inexpensive components to provide eye-catching visual effects. The resulting volumetric display is inexpensive, robust, and operable in a variety of both indoor and outdoor advertising environments.

In the volumetric display, a strobe source illuminates a moving object at successive instants separated by potentially unequal intervals. These instances of illumination, referred to as "illumination events," are determined by an illumination controller on the basis of the desired visual effect.

To determine the sequence of illumination events, the illumination controller relies on a signal generator that generates both a first signal and a second signal. These two signals are passed to the illumination controller to be interleaved into a sequence of illumination events. In response to the sequence of illumination events, the strobe source illuminates the moving object.

In one aspect of the invention, the signal generator includes a sampling unit that responds to the motion of the moving object, and/or the mechanical phase, or position, of the moving object. This sampling unit thus generates a first signal having a motion frequency associated with motion of the moving object. The sampling unit can, for example, be a divide-by-N block that generates a signal having a frequency obtained by dividing the frequency associated with the motion of the moving object by an integer. Such a sampling unit thus generates a frequency that is proportional to the motion frequency.

In one embodiment, the volumetric display generates entertaining visual effects by generating a second signal having a phase offset relative to the first signal. This causes the moving object to appear to jump discontinuously from one spatial orientation to another spatial orientation. A phase shifted version of the first signal is conveniently generated by interrupting the input to the sampling unit, thereby changing the phase of the its output.

In another embodiment, the second signal has a frequency that differs from the motion frequency associated with the motion of the moving object. Such a signal can conveniently generated by an oscillator tuned to a frequency that is offset from the frequency of the first signal. More complex visual effects can be achieved by providing additional oscillators tuned to frequencies that are offset from the frequency of the first signal by differing amounts.

In an optional feature of the invention, the volumetric display can interact with the viewer. This feature can be implemented, for example, by providing a sensor to detect the presence, position, and/or motion of a person in the vicinity of the display. The illumination controller can then use the output of this sensor to select a suitable visual display.

These and other features of the invention will be apparent from the accompanying detailed description and the figures, in which:

DETAILED DESCRIPTION

Figure 1:
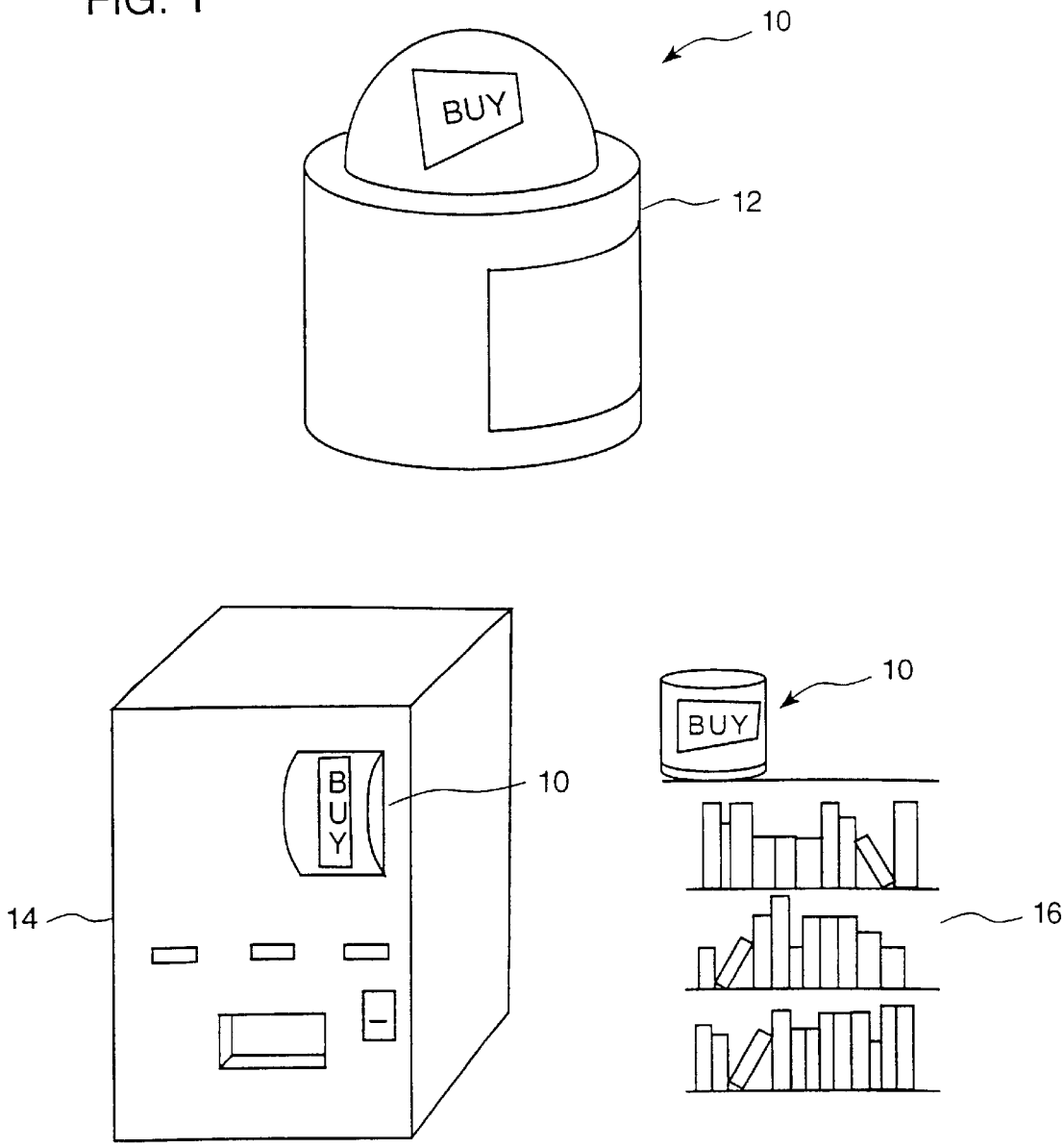
FIG. 1 shows several operating environments for installation of the volumetric display of the invention.

A volumetric display 10 according to the invention can be advantageously displayed for public view in a number of advertising environments, several of which are illustrated in FIG. 1. For example, the volumetric display 10 can be positioned atop a vendor's kiosk 12, on the front surface or in the interior of a vending machine 14, or on a store shelf display 16. In these and other environments, the volumetric display 10 can be seen by one or more viewers from a variety of angles.

Figure 2:
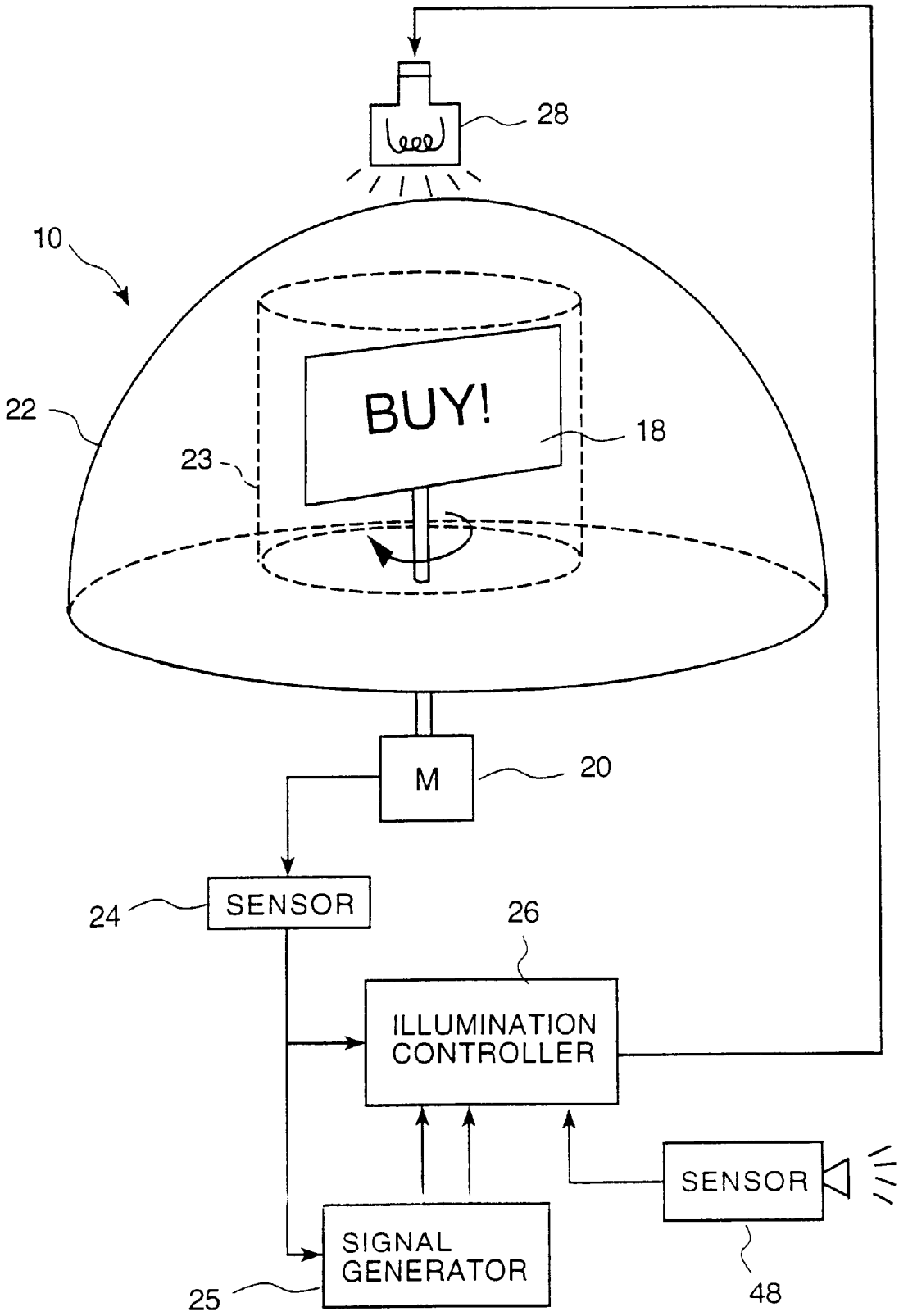
FIG. 2 shows a block diagram of the volumetric display of FIG. 1.

In a typical embodiment, shown in FIG. 2, the volumetric display 10 includes a moving object 18 coupled to a motor 20. The moving object 18 typically has an advertising messages on the front and back of a rectangular surface. The surface of the moving object 18, which is typically 6" (152.4 mm) across and 4" (101.6 mm) high, is made of 1/16 "(1.6 mm) thick Plexiglas. The moving object 18 can rectangle or other essentially two-dimensional shape. Alternatively, the moving object 18 can be a curve in three dimensions, such as a helix, or a three-dimensional solid, such as a soda can.

To protect the moving object 18 from the elements or from inquisitive onlookers, the volumetric display 10 optionally includes a transparent display cover 22 enclosing the moving object 18. The display cover 22 is preferably coated, or otherwise configured to increase the perceived brightness of the moving object 18. For example, a one-way mirror, one-way glass, wavelength-specific filters, or a system of polarizers can be used for a display cover 22.

The motor 20 coupled to the moving object 18 causes the moving object 18 to sweep out a display volume 23 by undergoing rapid, periodic motion. In FIG. 2, the moving object 18 undergoes rapid rotation of at least 10 revolutions per second, or ideally 20 revolutions per second. Although FIG. 2 shows a moving object 18 undergoing rotation, the coupling between the motor 20 and the moving object 18 can also result in translation, vibration, or oscillation of the moving object 18, all of which can sweep out a display volume 23 as shown in FIG. 2. The resulting motion of the moving object 18 can also be a combination of any of the foregoing types of motion in any direction.

A first sensor 24 coupled to the moving object 18 provides information concerning the rotational frequency and, optionally, the position of the moving object 18, to a signal generator 25. In the context of rotation, information concerning the position of the moving object 18 is embodied in the mechanical phase of the moving object 18.

In response to information provided by the first sensor 24, the signal generator 25 generates at least two signals. These signals are provided to a programmable illumination controller 26 that generates a sequence of illumination events by selectively sampling the signals and selecting particular samples with which to drive a strobe unit 28. In the context of this description, a strobe unit 28 is any unit that illuminates the moving object 18 with a sequence of light pulses, each of which is sufficiently short, relative to the motion of the moving object 18, to make the moving object appear to be stationary for the duration of the pulse. A strobe unit 28 can include flash lamps as well as LEDs and other light sources that emit short pulses. However, for slowly moving objects, the strobe unit 28 can be a conventional incandescent light controlled by a switch.

By sampling the signals and selecting from those samples in a controlled manner, the illumination controller 26 can generate eye-catching visual effects. For example, if the moving object 18 rotates at a frequency of at least 10 rps, the strobe unit 28 can illuminate the moving object 18 in a manner that: freezes the apparent position of the moving object 18; makes the moving object 18 appear to move at varying speeds in either direction; makes the element jump from one spatial orientation to another; makes the moving object 18 appear to have multiple elements which are rotating in an overlapping manner in the same, and or different, directions. In engineering parlance, the volumetric display 10 exploits temporal aliasing by using a programmable stroboscope to create an eye-catching three-dimensional display.

Figure 3:
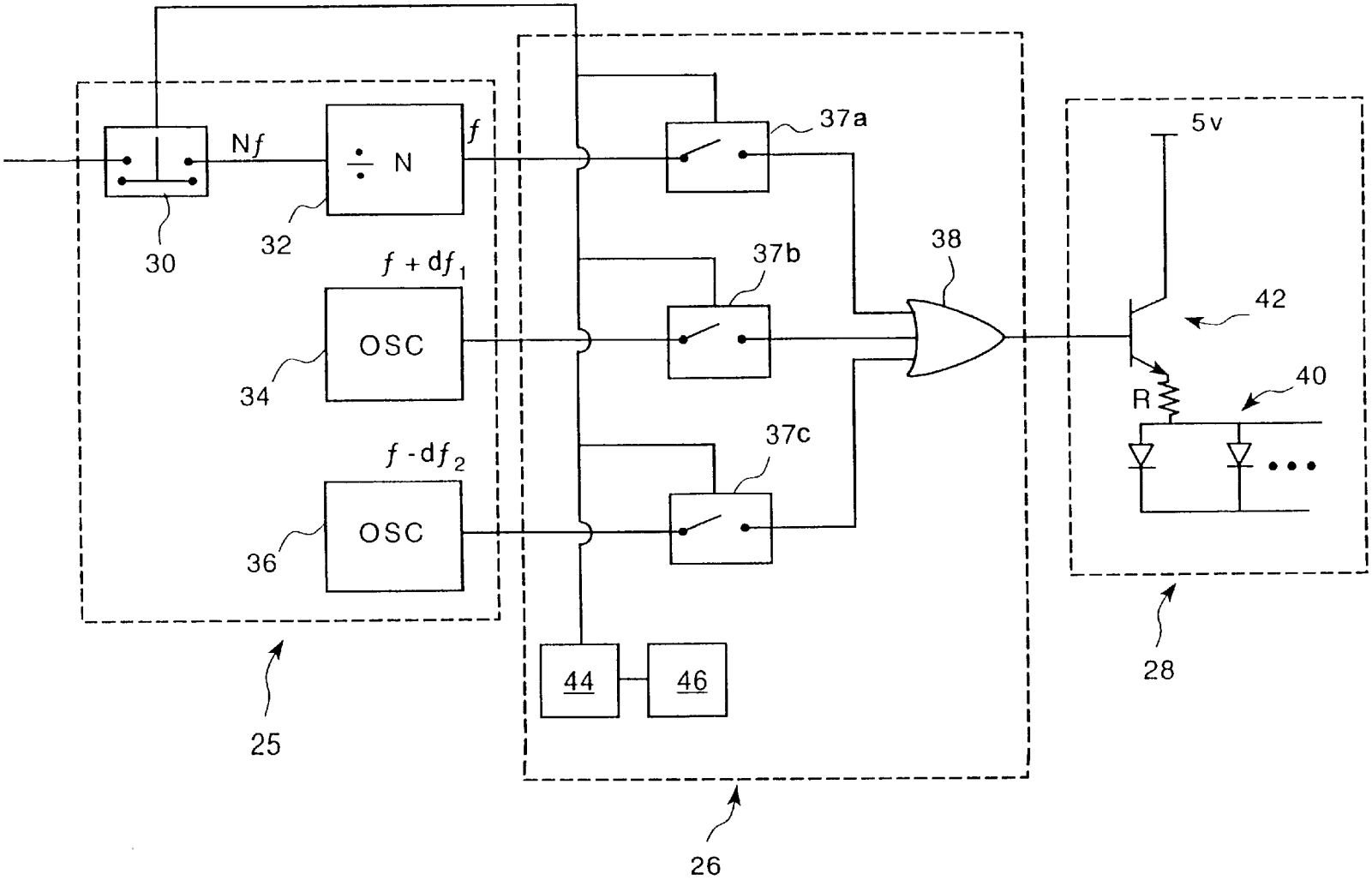
FIG. 3 shows the illumination controller and signal generator of FIG. 2.

FIG. 3 shows an embodiment in which the signal generator 25 receives, from the first sensor 24, a periodic signal that corresponds to the frequency of the motor 20. In most cases, this frequency is approximately 400 Hz. The first sensor 24 can also provide information on the position of the moving object 18 directly to the illumination controller 26. In the case of rotational motion of the moving object 18, this position corresponds to a mechanical phase. However, it is possible to create interesting effects even without a signal, such as mechanical phase, that indicates the position of the moving object 18.

Within the signal generator 25, an input switch 30 gates the periodic signal into a divide-by-N block 32 (shown here with N=20) to create a 20 Hz signal from the 400 Hz signal provided by the first sensor 24. In parallel, independent oscillators 34, 36 (such as simple 555 timers) create short pulses at frequencies close to the 20 Hz signal, such as 19 Hz and 21 Hz. The signal from the divide-by-N block 32 (the 20 Hz signal) and the signals from the oscillators 34, 36 (the 19 Hz and 21 Hz signals) are provided to the illumination controller 26.

Within the illumination controller 26, a first switch 37*a* samples the signal generated by the divide-by-N block 32. Similarly, second and third switches 37*b–c* sample the signals generated by the first and second oscillators 34, 36. These samples become inputs to an OR gate 38. The output of the OR gate 38 is a single stream of illumination events generated by selectively sampling the signals generated by the divide-by-N block 32, the first oscillator 34, and the second oscillator 36. The illumination controller 26 thus functions as a multiplexer that selects from three signal streams to form one output stream of illumination events.

The operation of the switches 37*a–c* and of the input switch 30 are under the control of a processor, such as a programmable logic array 44 or simple microcontroller, operating in conjunction with a low-frequency (typically 0.3 Hz) timer 46 to indicate a change-of-state. By controlling the operation of the input switch 30 and the sequence in which the individual switches 37*a–c* gate the various signals to the strobe unit, the programmable logic array 44 causes the illumination controller 26 to illuminate the moving object 18 in a manner that creates various eye-catching patterns.

In the illustrated embodiment, the illumination unit 28 includes 10 super-bright LEDs 40 controlled by a BJT switching circuit 42. The output of the OR gate 38 is connected to the base terminal of a BJT so that when the output of the OR gate 38 is high, current from the emitter terminal of the BJT is provided to the LEDs 40. However, using well-known drive circuitry, other light sources, such as, bright white-light flashlamps, can also be used.

Figure 4:
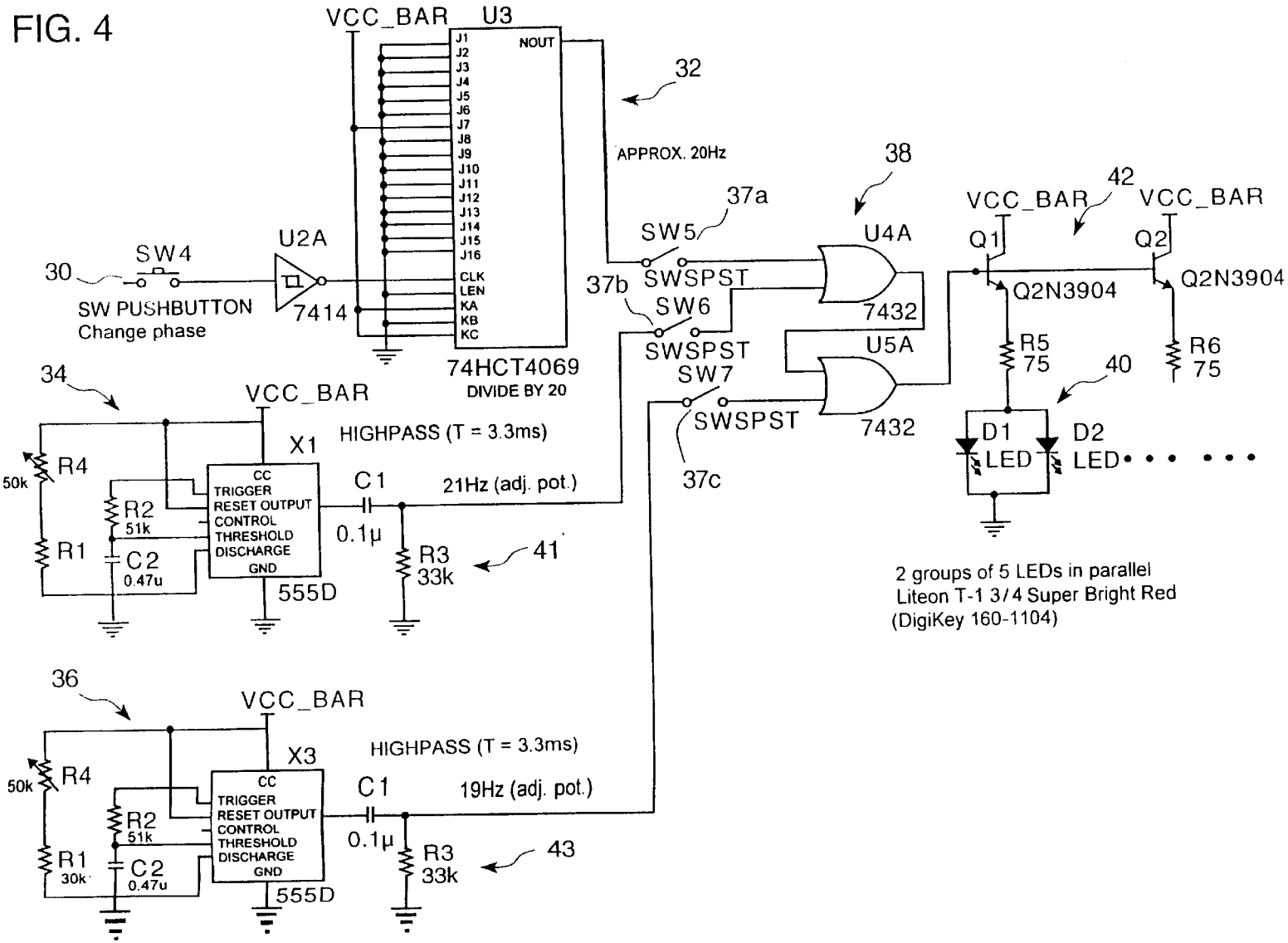
FIG. 4 shows a specific implementation of the illumination controller and signal generator of FIG. 2.

FIG. 4 is a schematic of an illumination unit 28 under manual (pushbutton and SPST switch) mode control. In this embodiment, a viewer can push the input switch 30 to change the phase of the signal provided at the output of the divide-by-N block 32. The illumination unit 28 includes several transistors 42, each one driving a parallel pair of LEDs 40. Each transistor 42 has a base driven by an output of a 3-input OR gate 32 formed by connecting the output of a first two-input OR gate to the input of a second two-input OR gate. The outputs of the first and second oscillators 34, 36 are passed through first and second high-pass filters 41, 43 before being provided to the OR gate 32 by way of the first and second switches 37*b*, 37*c*.

Optionally, the volumetric display 10 can include a second sensor 48, for example a motion sensor, to cause the volumetric display 10 to be responsive to the presence or motion of a viewer. The second sensor 48 can detect the presence of a viewer and/or the position of the position of one or more viewers. The second sensor 48 can then provide that information to the illumination controller 26 as shown in FIG. 2. In response to the viewers presence or position, the programmable logic array 44 can be programmed to cause the display 10 to interact with the viewer.

In operation, the first sensor 24 provides an input signal having a frequency Nf as shown in FIG. 3. If the input switch 30 is closed, the input signal passes through the divide-by-N block 32. The corresponding output of the divide-by-N block 32 is a first signal having a frequency f. If the first switch 37*a* is closed, this first signal causes the OR gate 38 to generate a series of output pulses at a frequency f. This series of output pulses causes the illumination unit 28 to illuminate the moving object 18 with periodic light pulses at a frequency of f. If the moving object 18 rotates at a frequency that is an integer multiple of f, the moving object 18 will appear to be standing still.

If a viewer, a microprocessor, or the programmable logic array 44 momentarily opens and then closes the input switch 30, the phase of the signal provided at the output of the divide-by-N block 32 will change relative to the mechanical phase of the moving object 18. This will cause a discontinuous phase change in the output of the OR gate 38 driving the strobe unit 18. As a result of this phase change, the moving object 18 will appear to instantaneously shift from a first spatial orientation to a second spatial orientation.

By applying the foregoing principle, the illumination controller 26 can be configured to cause the moving display 18 to shift from a first spatial orientation to a random second spatial orientation by randomly opening and closing the switch 37*a*. Alternatively, the shift to a random second spatial orientation can be achieved by inviting a viewer to press the input switch 30.

If information concerning the mechanical phase of the moving object 18 is available to the programmable logic array 44, the discontinuous shift from the first spatial orientation to the second spatial orientation be coordinated with the motion of the moving object 18. With this ability comes the ability to achieve additional eye-catching special effects. For example, a moving object 18 can have several faces, each of which has a different image. The orientation of the moving display 18 can then be controlled to give the effect of animating those images.

If the display 10 is equipped with the optional second sensor 48 as described above, then information concerning the presence and/or position of the viewer will be available. This allows the illumination controller to select the second spatial orientation on the basis of the viewer's activities, thereby permitting the wireless interaction of the moving object 18 with the viewer. For example, the viewing angle for the advertising message on the moving object 18 can be continuously adjusted to follow the viewer as the viewer moves around the display. Alternatively, the display 10 can be activated upon the approach of a viewer to attract the viewer's attention and then deactivated upon the viewer's departure to avoid premature wear and excessive power usage.

The input switch 30 and the divide-by-N block 32 thus cooperate to generate two signals. The first signal is a first pulse train having a frequency f and the signal is a second pulse train having the same frequency f but a different phase. These two signals can be temporally interleaved by periodically operating the input switch 30.

The two temporally interleaved signals are then provided to the illumination controller 26. Using the first switch 37*a*, the programmable logic array 44 samples this stream of two temporally interleaved signals and provides those samples to the OR gate 38. Depending on the instant that the programmable logic array 44 closes the first switch 37*a*, the sample provided to the OR gate 38 can arise from either the first signal or the second signal. In response to the sample provided at its input, the OR gate 38 generates a stream of pulses, each of which defines an illumination event that originates from either the first signal or the second signal.

The foregoing special effects are achieved without the aid of the independent oscillators 34, 36 shown in FIG. 3. The inclusion of these oscillators 34, 36 in the signal generator 25 and their associated their associated second and third switches 37*b*, 37*c* in the illumination controller 26 provides yet additional opportunities for eye-catching special effects.

In the illustrated signal generator 25, the first oscillator 34 generates a first pulse train at a frequency $f+df_1$ that is slightly higher than the frequency output by the divide-by-N block 32. This first pulse train thus forms the second signal of the signal generator 25, the first signal being the output of the divide-by-N block 32. The programmable logic array 44 selectively passes or withholds this second signal from the OR gate 38 by selectively operating the switch 37*b*. This results in the generation of a pulse train by the OR gate 38, each of the pulses being an illumination event arising from either the first signal, provided by the divide-by-N block 32, or from the second signal, provided by the first oscillator 34.

Under the control of the programmable logic array 44, the first oscillator 34 and the divide-by-N block 32 can cooperate to generate a three-dimensional display in which the moving object 18 appears to rotate simultaneously in two directions at two different angular velocities. For example, the first signal can illuminate the moving object 18 at a frequency slightly lower than the rotational frequency, thus generating the effect of a moving object 18 slowly rotating in a first direction. Meanwhile, the second signal can illuminate the moving object 18 at a frequency slightly higher than the rotational frequency, in which case the moving object 18 will appear to slowly rotate in a second direction opposite the first direction.

The second oscillator 36 generates a second pulse train at a frequency $f-df_2$ slightly lower than the frequency output by the divide-by-N block 32. Note that the frequency offsets $df_1$ and $df_2$ need not be identical. This second oscillator 36 operates in a manner identical to the first oscillator 34 as described above. This second oscillator 36, together with optional additional oscillators operating in the same manner, can further enhance the visual display by generating additional signals having frequencies that differ from the first and second signal.

Figure 5:
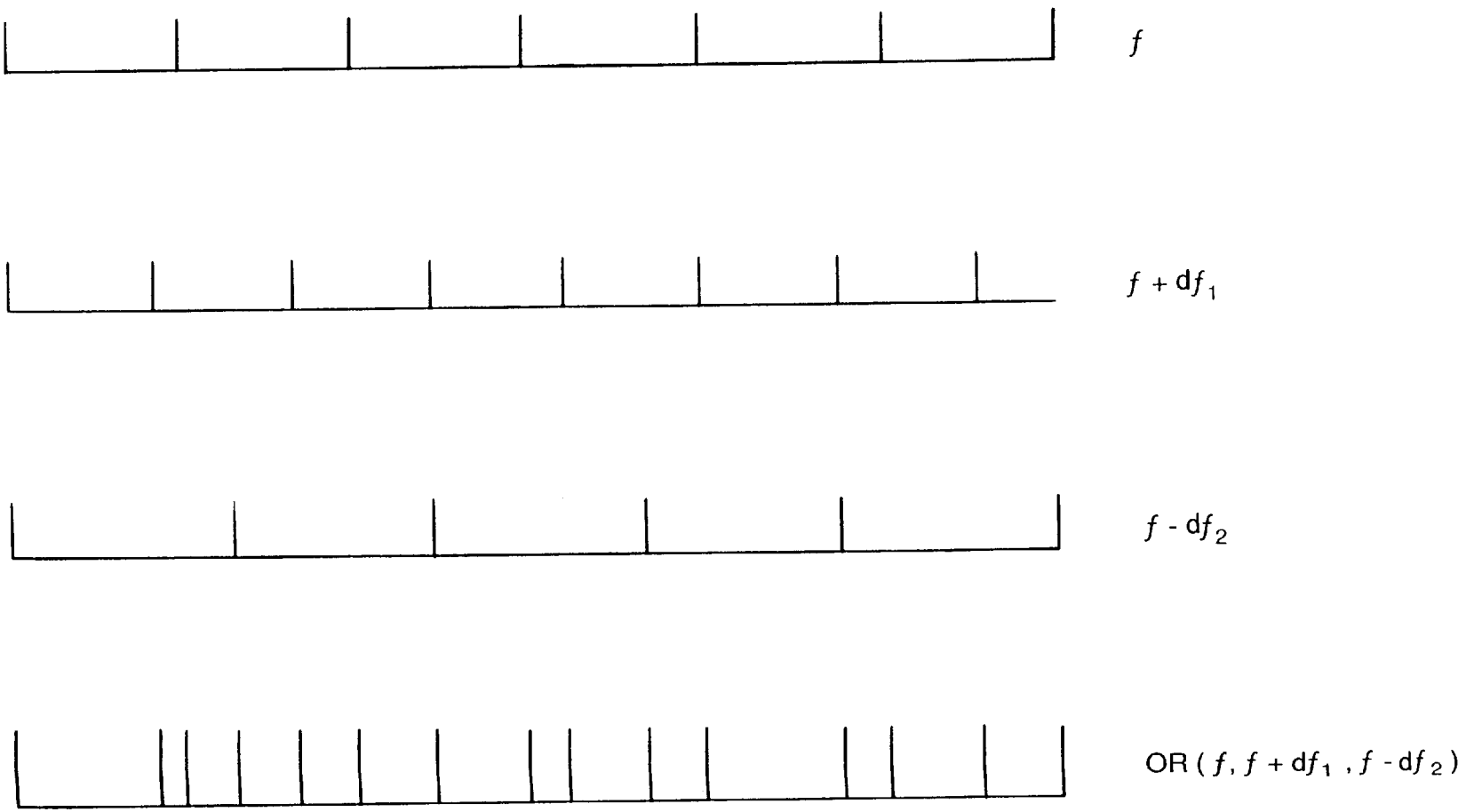
FIG. 5 shows examples of the manner in which the volumetric display interleaves two signals to generate a sequence of illumination events.

FIG. 5 illustrates the manner in which the OR gate 38 interleaves pulse trains having different frequencies to form a sequence of illumination events. The uppermost graph shows a first pulse train at a frequency f as generated by the divide-by-N block 32. The second and third graphs show second and third pulse trains at slightly higher ($f+df_1$) and slightly lower ($f-df_2$) frequencies as generated by the first and second oscillators 34, 36 respectively. When passed through the OR gate 38, these three pulse trains are interleaved, as shown in the bottom graph of FIG. 5, to form a sequence of illumination events.

By controlling the switches 37*a–c*, the illumination controller 26 can further manipulate the sequence of illumination events. For example, the second switch 37*b* could be controlled so as to sample only every other pulse in the second pulse train, thereby effectively halving its frequency. This can result in sudden, and hence eye-catching changes in the appearance of the moving object 18.

Although the above description contains many specifics, these should not be construed as limiting the scope of the invention but as merely providing illustrations of some of the presently preferred embodiments of this invention.

What we claim as new and secured by letters patent is:

1. A display apparatus for producing a visual effect, the apparatus comprising:

a signal generator configured to generate a first periodic signal and a second periodic signal;

an illumination controller in communication with the signal generator to combine the first and second periodic signals into a signal sequence; and a stroboscopic light source disposed to illuminate an image provided on a moving object in response to the signal sequence from the illumination controller;

wherein the illumination controller comprises a multiplexer for generating the pulse sequence by selecting from the first and second periodic signal, the multiplexer having a first input for receiving the first periodic signal and a second input for receiving the second periodic signal and an output connected to the stroboscopic light source.

2. The apparatus of claim 1 wherein the signal generator includes a sampling unit for generating a first signal having a frequency associated with motion of the moving object, the sampling unit having an input signal responsive to motion of the moving object.

3. The apparatus of claim 2 wherein the sampling unit comprises a divide-by-N block, the divide-by-N block generating the first periodic signal having a frequency proportional to the motion frequency associated with the moving object.

4. The apparatus of claim 2 further comprising a phase shifter in communication with the sampling unit for generating the second periodic signal having a phase offset relative to the first periodic signal.

5. The apparatus of claim 4 wherein the phase shifter comprises a switch for interrupting the input signal to the sampling unit, thereby causing the sampling unit to generate the second periodic signal having a phase offset relative to the first periodic signal.

6. The apparatus of claim 2 further comprising an oscillator for generating a second signal having a shifted frequency different from the motion frequency.

7. The apparatus of claim 1 wherein the illumination controller further comprises a controller in communication with the multiplexer for controlling the output of the multiplexer.

8. The apparatus of claim 1 wherein the multiplexer comprises an OR gate having a first input for receiving the first periodic signal and a second input for receiving the second periodic signal.

9. The apparatus of claim 8 further comprising a first switch for interrupting the transmission of the first periodic signal to the first input of the OR gate.

10. The apparatus of claim 9 further comprising a second switch for interrupting the transmission of the second periodic signal to the second input of the OR gate.

11. The apparatus of claim 9 further comprising a processor for controlling the first switch.

12. The apparatus of claim 10 further comprising a processor for controlling the first and second switch.

13. The apparatus of claim 9 wherein the processor comprises a programmable logic array.

14. The apparatus of claim 1 further comprising a sensor coupled to the moving object for providing information on the motion of the moving object to the illumination controller.

15. The apparatus of claim 1 further comprising a motor coupled to the moving object for causing the moving object to undergo motion selected from a group consisting of linear translation along a selected axis, and circumferential motion along a selected arc, and rotation about a selected axis.

16. The apparatus of claim 1 wherein the moving object is selected from a group consisting of a flat plate having an image on a first side and a three-dimensional structure.

17. The apparatus of claim 15 wherein the motion is an oscillatory motion.

18. The apparatus of claim 14 wherein the sensor provides information concerning the velocity of the moving object.

19. The apparatus of claim 14 wherein the sensor provides information concerning the mechanical phase of the moving object.

20. The apparatus of claim 1 wherein the signal generator generates the first periodic signal to cause the stroboscopic light source to generate a first sequence of light pulses at a first frequency and the signal generator generates the second periodic signal to cause the stroboscopic light source to generate a second sequence of light pulses at a second frequency that differs from the first frequency.

21. The apparatus of claim 1 wherein the signal generator generates the first periodic signal to cause the stroboscopic light source to generate a first sequence of light pulses at a first phase and the signal generator generates the second periodic signal to cause the stroboscopic light source to generate a second sequence of light pulses at a second phase that differs from the first phase.

22. The apparatus of claim 1 wherein the illumination controller is configured to modulate the first and second periodic signals at different phases.

23. The apparatus of claim 1 wherein the stroboscopic light source comprises a light source selected from a group consisting of a light emitting diode, a laser, and a flash lamp.

24. The apparatus of claim 1 further comprising a detector in communication with the signal generator, the detector being configured to detect the presence of a person in the vicinity of the moving object and the signal generator is configured to generate the first and second periodic signals in response to the presence of the person.

25. The apparatus of claim 24 wherein the detector is configured to detect the position in the vicinity of the moving object and the signal generator is configured to generate the first and second periodic signals in response to the position of the person.

26. The apparatus of claim 1 further comprising a processor in communication with the illumination controller, the processor having a viewer interface through which a viewer can interact with the illumination controller.

* * * * *